US005501300A

United States Patent [19]

Cho

[11] Patent Number: 5,501,300

[45] Date of Patent: Mar. 26, 1996

[54] MOVER VIBRATION ABSORBING DEVICE FOR LINEAR MOTOR ELEVATOR

[75] Inventor: Kil H. Cho, Changwon, Rep. of Korea

[73] Assignee: LG Industrial Systems Co., Ltd., Seoul, Rep. of Korea

[21] Appl. No.: 329,473

[22] Filed: Oct. 26, 1994

[30] Foreign Application Priority Data

Nov. 5, 1993 [KR] Rep. of Korea ..... 23119/1993

[51] Int. Cl.[6] ..... B66B 1/28

[52] U.S. Cl. ..... 187/289; 187/292; 187/404

[58] Field of Search ..... 187/292, 289, 187/345, 404, 409

[56] References Cited

FOREIGN PATENT DOCUMENTS 4169490 6/1992 Japan ..... 187/404 X 6211467 8/1994 Japan ..... 187/289 X

*Primary Examiner*—William E. Terrell
*Assistant Examiner*—Dean A. Reichard
*Attorney, Agent, or Firm*—Oliff & Berridge

[57] ABSTRACT

A mover vibration absorbing device for a linear motor elevator is described. The device includes top and bottom frames provided on top and bottom of a counter support unit respectively. A plurality of top steel plates are coupled to flanges of the top and bottom frames respectively. Top and bottom support members are provided on top and bottom surfaces of a hollow cylindrical mover of the linear motor respectively. A plurality of bottom steel plates are coupled to flanges of the top and bottom support members respectively. Top and bottom vibration absorbing rubbers each are interposed between an associated top steel plate and an associated bottom steel plate. Bolts and nuts are adapted for fixing the top steel plates to the flanges of the top and bottom frames and for fixing the bottom steel plates to the flanges of the top and bottom support members.

6 Claims, 5 Drawing Sheets

MOVER VIBRATION ABSORBING DEVICE FOR LINEAR MOTOR ELEVATOR

BACKGROUND OF THE INVENTION

1. Field of the Invention

The present invention relates in general to a mover vibration absorbing device for a linear motor elevator and, more particularly, to a structural improvement in a vibration absorbing rubber of the device for reliably absorbing the operational vibration generated when an elevator car is accelerated or decelerated abruptly.

2. Description of the Prior Art

With reference to FIG. 1, there is shown in a perspective view a linear motor elevator having a typical mover vibration absorbing device. As shown in this drawing, the elevator includes a pair of horizontal support shafts 1 whose opposite ends are fixed to a pair of side support frames 2 so that the shafts 1 are arranged in parallel and spaced out at an interval. Each of the support shafts 1 is provided with a pair of rotatable pulleys 3. Two ropes 5 are wrapped about the pulleys 3 so that each rope 5 is commonly wrapped about one of the pulleys 3 of the first shaft 1 and about one of the pulleys 3 of the second shaft 1. One end of each of the ropes 5 is commonly connected to an elevator car 4, while the other end of each of the ropes 5 is commonly connected to a counter support unit 20.

The counter support unit 20 which is commonly connected to the other ends of the ropes 5 is a right-angled hexahedral unit whose front and rear walls open to the front and to the back respectively. The unit 20 is provided with a linear motor stator 6 of the rod type, which motor stator 6 vertically penetrates the right-angled hexahedral unit 20. The top end of the vertically arranged stator 6 is fixed to the center of the bottom surface of a top support frame 2*a*, while the bottom end of the stator 6 is fixed to the center of a bottom support frame 8. A hollow cylindrical mover 7 of the linear motor is fixedly placed in the center of the counter support unit 20. The stator 6 vertically penetrates the mover 7, so that the mover 7 vertically rectilinearly reciprocates while sliding on the vertically arranged stator 6.

Vertically placed in the opposed sides of the counter support unit 20 having the mover 7 is a pair of first guide rails 9. The first guide rails 9, which are adapted for guiding the vertical reciprocation of counter support unit 20 driven by the linear motor, are parallel with and spaced from the stator 6 at the same interval. In order to guide the vertical reciprocation of the elevator car 4, a pair of second guide rails 9*a* are vertically placed in the opposed sides of the car 4.

If described in detail the counter support unit 20 in conjunction with FIGS. 2A, 2B and 3, the bottom section and the top section of the mover 7 fixedly placed in the center of the unit 20 are connected to top and bottom frames 21 and 22 respectively. The top and bottom frames 21 and 22, which in turn are connected to the top and bottom surfaces of the unit 20, are lengthwise slitted in their centers so as to become hollow frames. The interiors of the top and bottom frames 21 and 22 are hollowed, so that they make their engagement with hollow ring type top and bottom vibration absorbing rubbers 30 and 40 more firmly. The counter support unit 20 is also provided with auxiliary supports 23 which are engaged with the interior sides of the unit 20. The width of the auxiliary supports 23 is slightly smaller than the width of the counter support unit 20.

In the above elevator, the top surface of the mover 7 may severely collide on a flange 21*a* of the top frame 21 and generate a severe mechanical vibration when the elevator car 4 is accelerated or decelerated abruptly. In order to absorb the collision vibration, the elevator includes a vibration absorbing device. The vibration absorbing device comprises a top vibration absorbing unit 50 which includes the flange 21*a* of the top frame 21, a top support member 31 and the plurality of top vibration absorbing rubbers 30.

In the same manner, the bottom surface of the mover 7 may severely collide on a flange 22*a* of the bottom frame 22 and generate a severe mechanical vibration when the elevator car 4 is accelerated or decelerated abruptly. In order to absorb the collision vibration, the elevator also includes a bottom vibration absorbing unit 51 which comprises the flange 22*a* of the bottom frame 22, a bottom support member 41 and the plurality of bottom vibration absorbing rubbers 40. The top and bottom vibration absorbing units 50 and 51 constitute the typical vibration absorbing device.

Hereinbelow, the constructions of the top and bottom vibration absorbing units 50 and 51 of the device will be described in more detail.

In the top vibration absorbing unit 50, the hollow cylindrical top support member 31 is mounted on the top surface of the hollow cylindrical mover 7 as shown in FIG. 3. Four vibration absorbing rubbers or the top vibration absorbing rubbers 30 are placed in the space between the flange 21*a* of the top frame 21 and a flange 31*a* of the top support member 31, so that the four top rubbers 30 are spaced out at 90° angles. In order to assemble the elements into the top vibration absorbing unit 50, a plurality of first bolts 32 upwardly penetrate the flange 31*a* of the top support member 31, their associated hollow ring type top vibration absorbing rubbers 30 and the flange 21*a* of the top frame 21. The first bolts 32 in turn are tightly engaged with their associated first nuts 33 on the top surface of the flange 21*a* of the top frame 21.

In the bottom vibration absorbing unit 51, the hollow cylindrical bottom support member 41 is mounted on the bottom surface of the hollow cylindrical mover 7 as shown in FIG. 3. Four vibration absorbing rubbers or the bottom vibration absorbing rubbers 40 are placed in the space between the flange 22*a* of the bottom frame 22 and a flange 41*a* of the bottom support member 41, so that the four bottom rubbers 40 are spaced out at 90° angles. In order to assemble the elements into the bottom vibration absorbing unit 51, a plurality of second bolts 42 downwardly penetrate the flange 41*a* of the bottom support member 41, their associated hollow ring type bottom vibration absorbing rubbers 40 and the flange 22*a* of the bottom frame 22. The second bolts 42 in turn are tightly engaged with their associated second nuts 43 on the bottom surface of the flange 22*a* of the bottom frame 22.

In operation of the above linear motor elevator, the mover 7 is applied with electric power, so that the linear motor is started. A conductive magnetic field is thus generated between the stator 6 and the mover 7 of the linear motor, thus to make the mover 7 together with the counter support unit 20 vertically move upward or downward along the vertically arranged stator 6 under the guide of the first guide rails 9. Therefore, the elevator car 4 which cooperates with the counter support unit 20 vertically moves downward or upward under the guide of the second guide rails 9*a*.

In the vertical reciprocating motion of the elevator car 4 of the above linear motor elevator, the mechanical vibration caused by collision of the top and bottom surfaces of the mover 7 on the top and bottom frames 21 and 22 when the elevator car 4 is accelerated or decelerated abruptly is absorbed by the top and bottom vibration absorbing rubbers 30 and 40. That is, the impact which is generated in both the flange 21*a* of the top frame 21 and the flange 31*a* of the top support member 31 due to collision of the top surface of the mover 7 on the top frame 21 is absorbed by the top vibration absorbing unit 50. In the top vibration unit 50, the flange 31*a* of the top frame 31 moves upward under the guide of the threadless shank sections of the first bolts 32 penetrating the ring type top vibration absorbing rubbers 30, thus to compress the rubbers 30 and to make the rubbers 30 absorb the collision impact.

In the same manner, the impact which is generated in both the flange 22*a* of the bottom frame 22 and the flange 41*a* of the bottom support member 41 due to collision of the bottom surface of the mover 7 on the bottom frame 22 is absorbed by the bottom vibration absorbing unit 51. In the bottom vibration unit 51, the flange 41*a* of the bottom frame 41 moves downwardly under the guide of the threadless shank sections of the second bolts 42 penetrating the ring type bottom vibration absorbing rubbers 40, thus to compress the rubbers 40 and to make the rubbers 40 absorb the collision vibration.

However, in the typical vibration absorbing device, the bottom vibration absorbing rubbers 40 are directly applied with weight of the mover 7 when the elevator car 4 is stopped. The bottom vibration absorbing rubbers 40 are thus always compressed by the weight of the mover 7 during stop of the elevator car 4. In this regard, the elastic restoring forces of the bottom vibration absorbing rubbers 40 will be more reduced than the elastic restoring forces of the top vibration absorbing rubbers 30 after lapse of predetermined time.

As described above, the typical vibration absorbing device for the linear motor elevator is designed so that the bottom vibration absorbing rubbers are directly applied with the compression force of the mover of the linear motor. Hence, the vibration absorbing device has a problem that the elastic restoring forces of the bottom vibration absorbing rubbers are more reduced than the elastic restoring forces of the top vibration absorbing rubbers. Furthermore, in the top vibration absorbing unit of the device, gaps will be formed between the bottom surface of the flange of the top frame and the top surfaces of the top vibration absorbing rubbers as well as between the top surface of the flange of the top support member and the bottom surfaces of the top vibration absorbing rubbers due to the weight of the mover after lapse of predetermined time. With the gaps, the top frame is separated from the mover, so that the mover fails in coming into even contact with the top vibration absorbing rubbers whenever the mover of the linear motor is started or stopped. This causes uneven abrasion of the top vibration absorbing rubbers and generates vibration of the counter support unit and vibration of the elevator car.

SUMMARY OF THE INVENTION

It is, therefore, an object of the present invention to provide a mover vibration absorbing device for a linear motor elevator in which the above problems can be overcome and which reliably absorbs the vibration generated in abrupt acceleration or abrupt deceleration of an elevator car and achieves smooth vibration absorbing effect in a normal speed operation of the elevator car.

In order to accomplish the above object, a mover vibration absorbing device for a linear motor elevator in accordance with a preferred embodiment of the invention comprises: top and bottom frames provided on top and bottom of a counter support unit respectively; top steel plates coupled to flanges of the top and bottom frames respectively; top and bottom support members provided on top and bottom surfaces of a hollow cylindrical mover of the linear motor respectively; bottom steel plates coupled to flanges of the top and bottom support members respectively; top and bottom vibration absorbing rubbers, each of the rubbers being interposed between an associated top steel plate and an associated bottom steel plate; and fixing means for fixing the top steel plates to the flanges of the top and bottom frames and for fixing the bottom steel plates to the flanges of the top and bottom support members.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
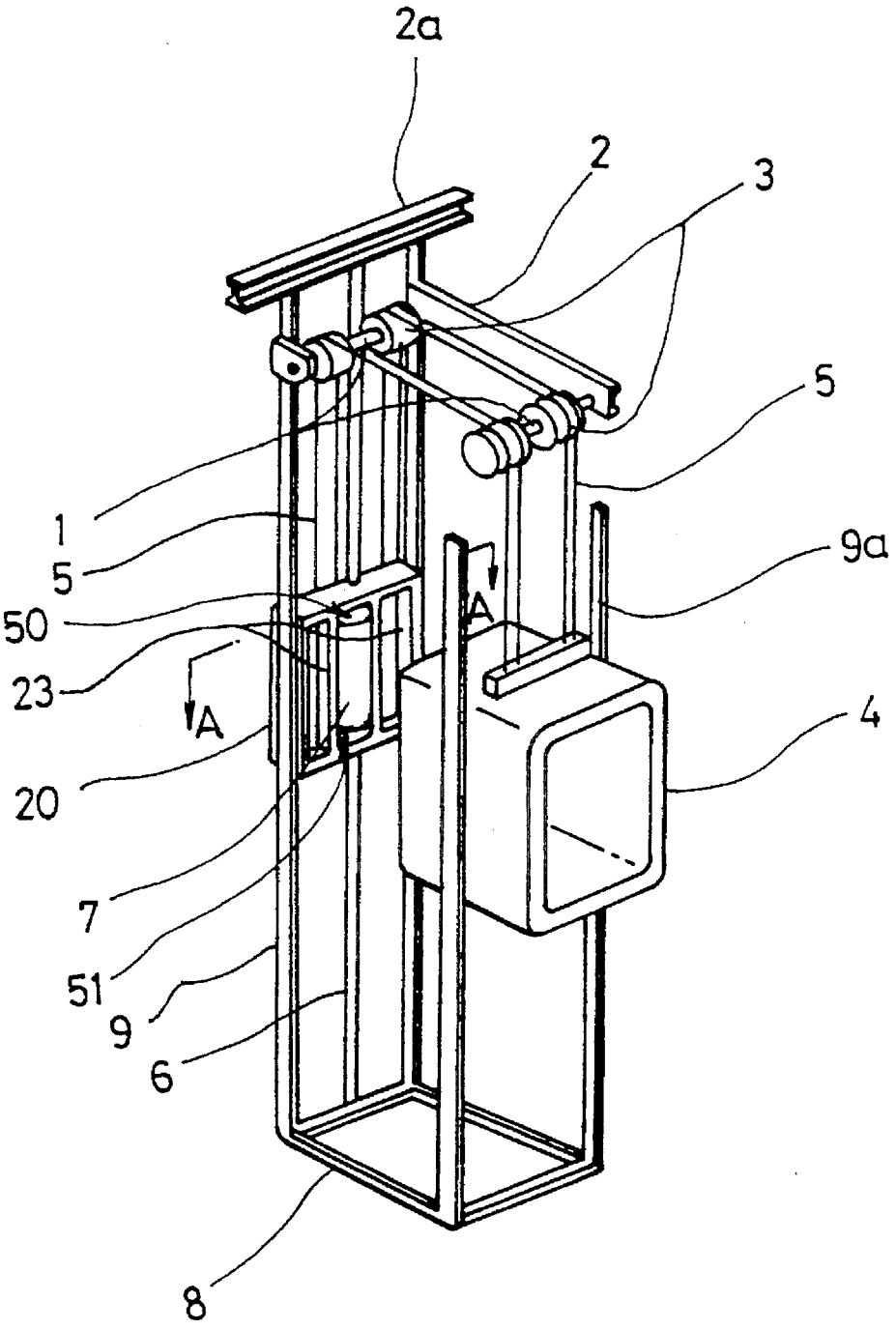
FIG. 1 CONVENTIONAL ART
FIG. 1 is a perspective view a linear motor elevator having a typical mover vibration absorbing device.
Figure 2A:
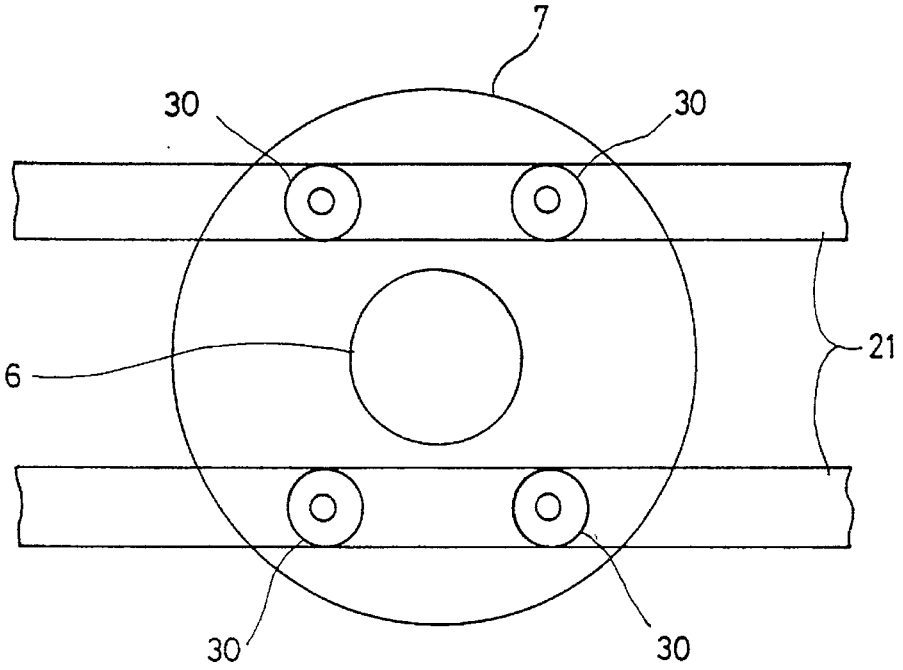
FIG. 2A CONVENTIONAL ART
FIG. 2A is a plan view showing a top frame of a counter support unit engaged with top vibration absorbing rubbers of the typical vibration absorbing device.
Figure 2B:
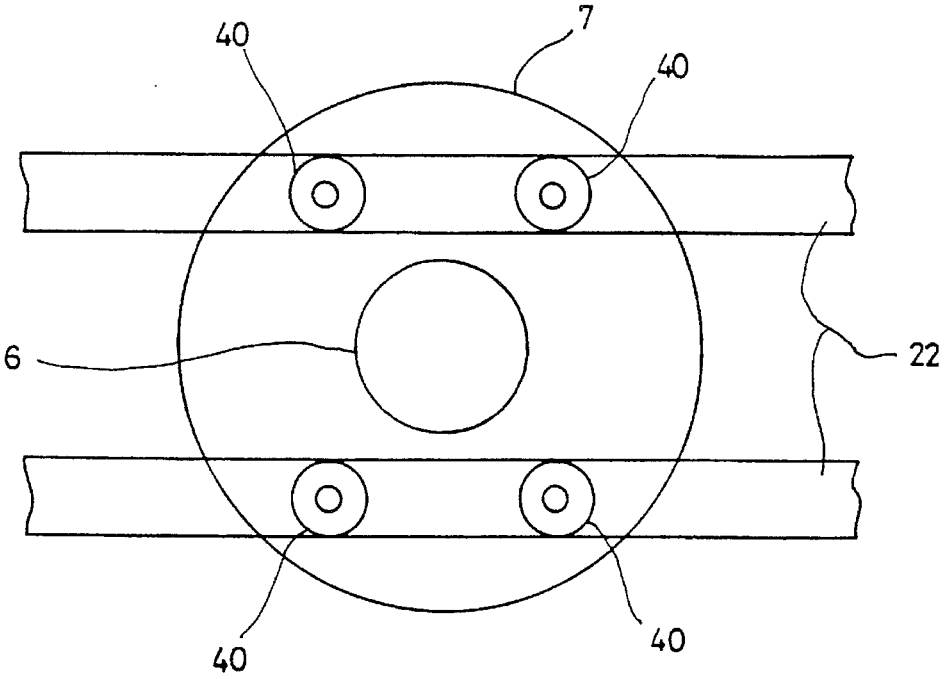
FIG. 2B CONVENTIONAL ART
FIG. 2B is a plan view showing a bottom frame of the counter support unit engaged with bottom vibration absorbing rubbers of the typical vibration absorbing device.
Figure 3:
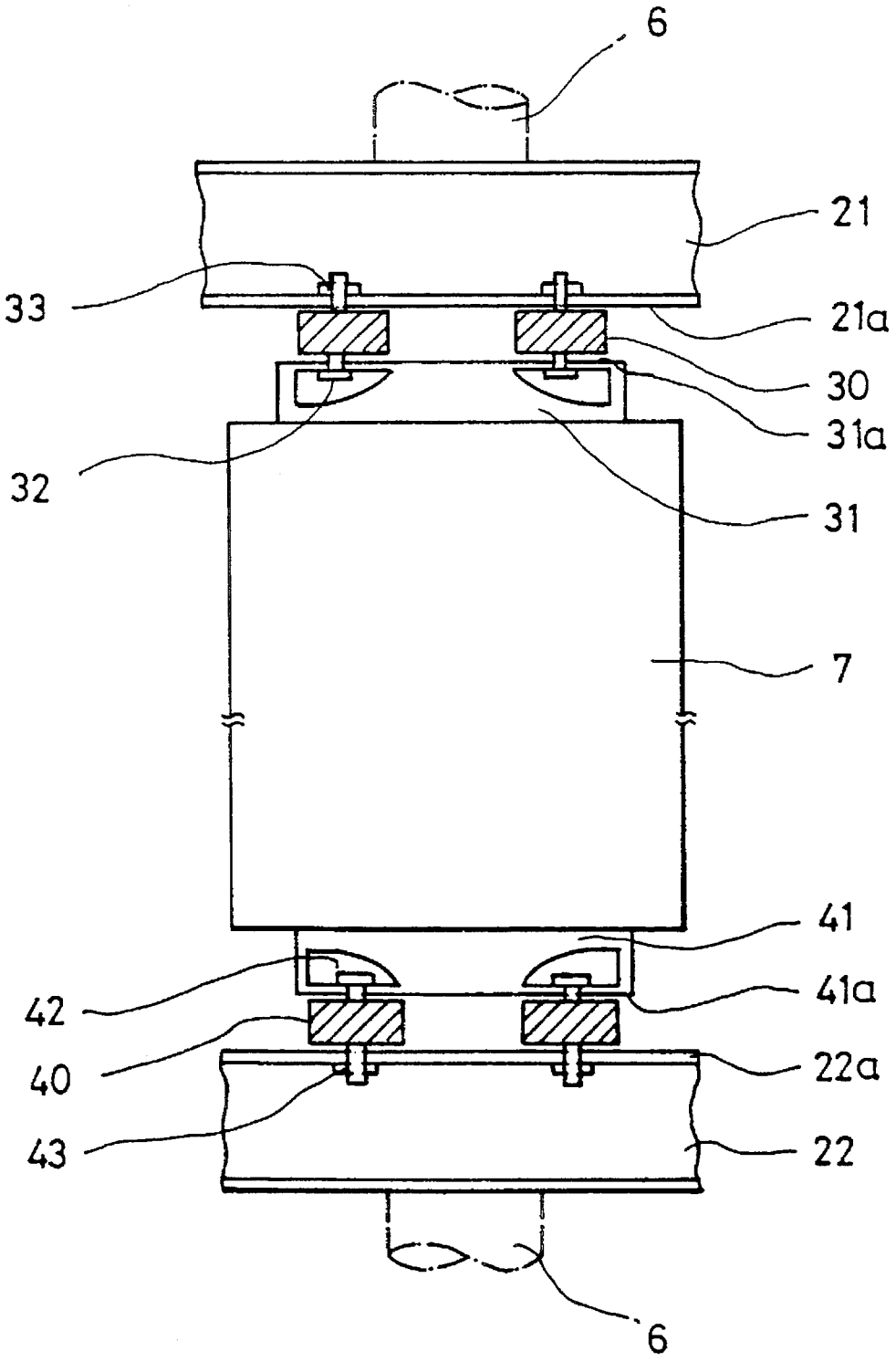
FIG. 3 CONVENTIONAL ART
FIG. 3 is a sectional view taken along the section line A—A of FIG. 1, showing a construction of the typical vibration absorbing device.

In a mover vibration absorbing device for a linear motor elevator of the present invention, both the configuration and the construction of the elevator is similar to those of the prior embodiment of FIG. 1, but the top and bottom vibration absorbing units are altered to achieve the object of the invention. Hence, further explanation for the configuration and the construction of the elevator will not be given in the following description.

Figure 4:
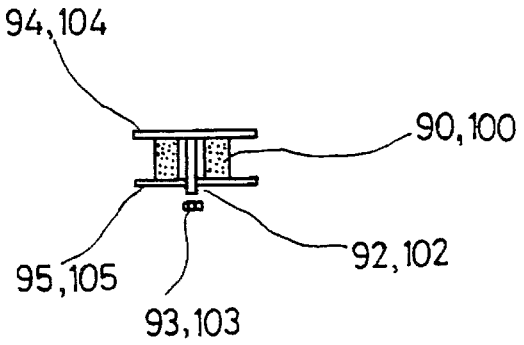
FIG. 4 is an exploded sectional view of a vibration absorbing rubber of a mover vibration absorbing device in accordance with the present invention.

As shown in FIG. 4, the vibration absorbing device according to a preferred embodiment of the invention is characterized by a novel configuration of top vibration absorbing rubbers 90 and of bottom vibration absorbing rubbers 100, which rubbers 90 and 100 are provided for the counter support unit 20 (see FIG. 1 ) of the elevator so as to absorb the mechanical vibration caused by collision of the mover 67 with top and bottom flames 81 and 82. Please note that only the top vibration absorbing rubbers 90 are described in the following description as the top and bottom rubbers 90 and 100 have the same configuration and the same operational effect.

Each top vibration absorbing rubber 90 of a hollow ring type is coupled to a top steel plate 94 and to a bottom steel plate 95 at the top and at the bottom of the rubber 90, which steel plates 94 and 95 are discs having a larger diameter than the outer diameter of the annular rubber 90. A first bolt 92 is welded to the center of the top plate 94, while a bolt receiving hole (not shown) for receiving the first bolt 92 therethrough is formed in the center of the bottom plate 95. In assembling the elements into the top vibration absorbing unit 110; the first bolt 92 of each top plate 94 is received into the bolt receiving hole of an associated bottom plate 95 after passing an internal hole (not shown) of an associated top vibration absorbing rubber 90, so that the bolt 92 projects out of the bottom surface of the bottom plate 95. The threaded shank section of the bolt 92 projecting out of the bottom plate 95 is, thereafter, engaged with a first nut 93. The first nut 93 is tightened by predetermined force, so that the top vibration absorbing rubber 90 is appropriately compressed between the top plate 94 and the bottom plate 95. Please note that each of the bottom vibration absorbing rubbers 100 is more compressed than each top rubber 90, so that the bottom rubber 100 overcomes the weight of the mover 67 of the linear motor.

As a result of compressing the top and bottom rubbers 90 and 100 by respectively tightening first and second nuts 93 and 103 to the first and second bolts 92 and 102, the heights of the rubbers 90 and 100 become shortened, while the centers of the rubbers 90 and 100 are bulged. The top and bottom rubbers 90 and 100 compressed as above described have their elastic restoring forces in upward and downward directions respectively. As each bottom rubber 100 is more compressed than each top rubber 90, the height of the compressed bottom rubber 100 is lower than the compressed top rubber 90.

Figure 5:
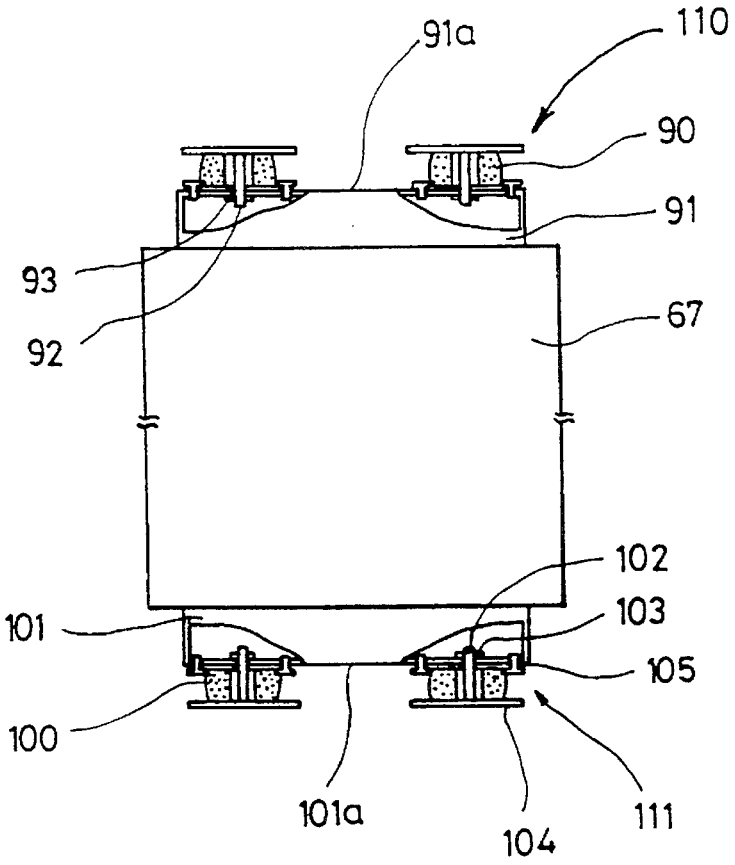
FIG. 5 is a view corresponding to FIG. 3, but showing the present invention in an exploded sectional view.
Figure 6:
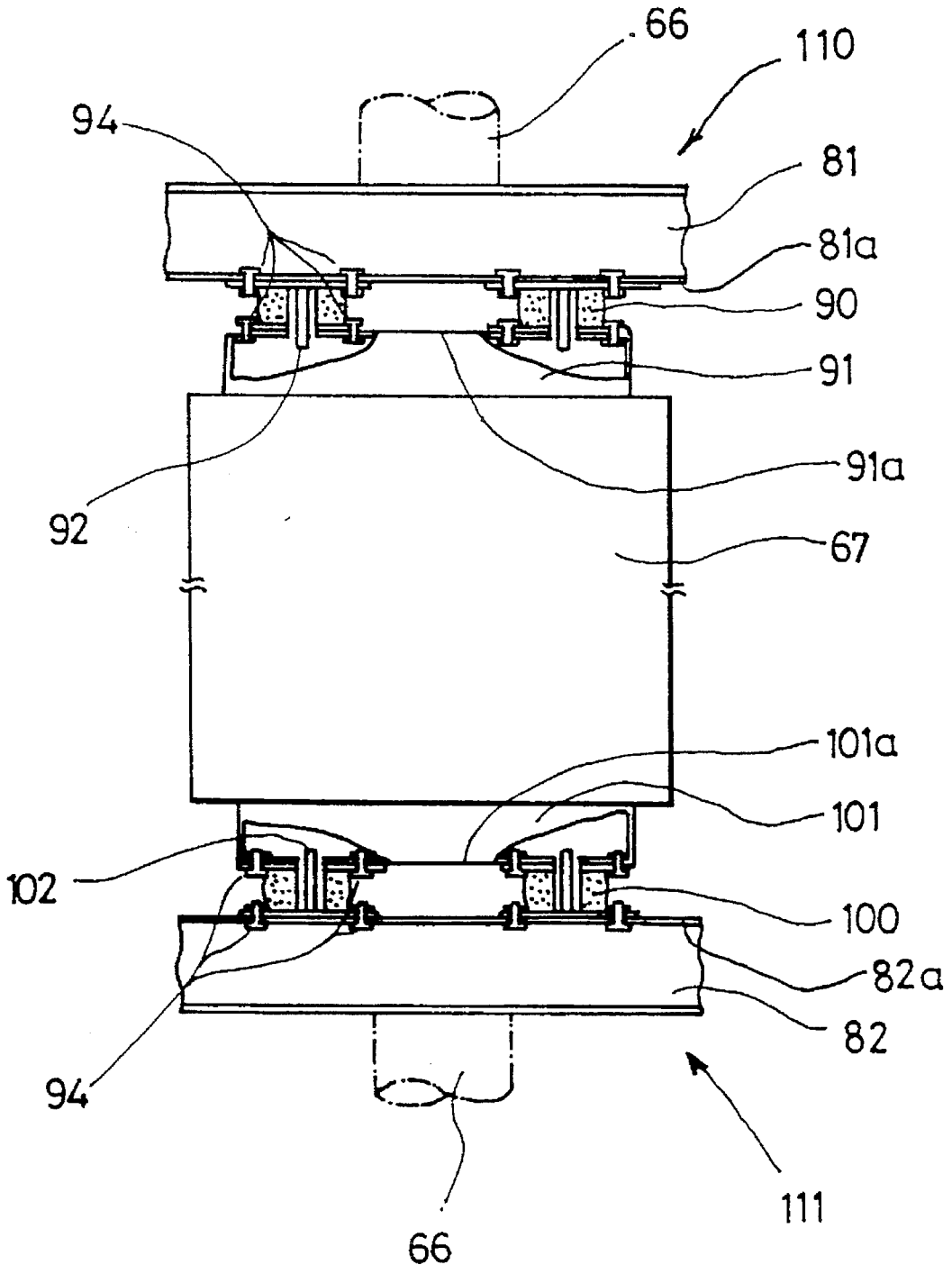
FIG. 6 is a view corresponding to FIG. 3, but showing the present invention.

In a top vibration absorbing unit 110, a hollow cylindrical top support member 91 is mounted on the top surface of the hollow cylindrical mover 67 as shown in FIGS. 5 and 6. Four vibration absorbing rubbers or the top vibration absorbing rubbers 90 are placed in the space between a flange 81*a* of the top frame 81 and a flange 91*a* of the top support member 91, so that the four top rubbers 90 are spaced out at 90° angles. In order to assemble the top vibration absorbing unit 110, four ends of the bottom plate 95 of each top rubber 90 are fixed to the flange 91*a* of the top support member 91 using fixing means or by bolts and nuts 93, so that the four ends of the bottom plate 95 are spaced out at 90° angles. In addition, the top plate 94 of each top rubber 90 is faced to the flange 81*a* of the top frame 81 in the same manner as described for the bottom plate 95 of the top rubber 90.

In the bottom vibration absorbing unit 111, a hollow cylindrical bottom support member 101 is mounted on the bottom surface of the hollow cylindrical mover 67. Four vibration absorbing rubbers or the bottom vibration absorbing rubbers 100 are placed in the space between a flange 82*a* of the bottom frame 82 and a flange 101*a* of the bottom support member 101, so that the four bottom rubbers 100 are spaced out at 90° angles. In order to assemble the bottom vibration absorbing unit 111, four ends of the top plate 104 of each bottom rubber 100 are fixed to the flange 101*a* of the bottom support member 101 using fixing means or by bolts and nuts 103, so that the four ends of the top plate 104 are spaced out at 90° angles. In addition, the bottom plate 105 of each bottom rubber 100 is fixed to the flange 82*a* of the bottom frame 82 in the same manner as described for the top plate 104 of the rubber 100.

After assembling the top and bottom vibration absorbing units 110 and 111, the first nuts 93 and the second nuts 103 which compress the top rubbers 90 and the bottom rubbers 100 respectively are appropriately loosened, so that the top rubbers 90 and the bottom rubbers 100 are provided with their predetermined elastic restoring forces. In this case, the top support member 91, to which the top of the mover 67 is connected, and the top frame 81 are tightly coupled to each other by the top rubbers 90 and by the fixing means 92,93. In the same manner, the bottom support member 101, to which the bottom of the mover 67 is connected, and the bottom frame 82 are tightly coupled to each other by the bottom rubbers 100 and by the fixing means 102,103. Therefore, even when the first nuts 93 of the top unit 110 are loosened as described above, the mover 67 does not go down under its own weight. However, the top and the bottom of the mover 67 are compressed by the elastic restoring forces of the top and bottom rubbers 90 and 100 respectively.

In FIG. 4, the reference numeral 102 denotes the second bolts for the bottom vibration absorbing rubbers 100.

The elastic restoring forces of the bottom vibration absorbing rubbers 100 of the device of this invention are not reduced irrespective of long time use of the elevator differently from the prior embodiment. The vibration absorbing device of this invention thus reliably absorbs the vibration generated in abrupt acceleration or abrupt deceleration of an elevator car and causes vibration in neither the counter support unit nor the elevator car.

As described above, in a mover vibration absorbing device for a linear motor elevator of the invention, the top vibration absorbing rubbers and the bottom vibration absorbing rubbers are placed between the top of the counter support unit and the top surface of the mover and between the bottom of the counter support unit and the bottom surface of the mover while being compressed by their top and bottom steel plates respectively. In this regard, the top and bottom vibration absorbing rubbers are not reduced in their elastic restoring forces irrespective of long time use of elevator, but reliably absorb the vibration. The vibration absorbing device of the invention reliably absorbs the vibration generated in abrupt acceleration or abrupt deceleration of an elevator car and achieves smooth vibration absorbing effect in a normal speed operation of the elevator car.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. In a mover vibration absorbing device for a linear motor elevator, said elevator comprising a counter support unit vertically reciprocated by a linear motor in the opposite direction of an elevator car, a rod type stator vertically penetrating the counter support unit and fixed at its top and bottom ends to a top support frame and to a bottom support frame, and a hollow cylindrical mover placed in the center of the counter support unit and slidably receiving at its center the stator and vertically reciprocated along the stator, the improvement comprising:

top and bottom frames provided on top and bottom of said counter support unit respectively;

top steel plates coupled to flanges of the top and bottom frames respectively;

top and bottom support members provided on top and bottom surfaces of the hollow cylindrical mover respectively;

bottom steel plates coupled to flanges of said top and bottom support members respectively;

top and bottom vibration absorbing rubbers, each of said rubbers being interposed between an associated top steel plate and an associated bottom steel plate; and fixing means for fixing the top steel plates to the flanges of the top and bottom frames and for fixing the bottom steel plates to the flanges of the top and bottom support members.

2. The mover vibration absorbing device according to claim 1, wherein said device has at least two top vibration absorbing rubbers and at least two bottom vibration absorbing rubbers.

3. The mover vibration absorbing device according to claim 1, wherein said top and bottom vibration absorbing rubbers are compressed with interposition between said top and bottom steel plates by bolts and nuts at a predetermined pressure.

4. The mover vibration absorbing device according to claim 3, wherein said top and bottom steel plates are tightened to or loosened from each other by bolts and nuts so as to compress the top and bottom vibration absorbing rubbers at the predetermined pressure.

5. The mover vibration absorbing device according to claim 3, wherein an elastic restoring force of each said bottom vibration absorbing rubber is stronger than that of each said top vibration absorbing rubber.

6. The mover vibration absorbing device according to claim 1, wherein said fixing means comprises at least two bolts and at least two nuts.

* * * * *